US006042216A

United States Patent [19]

Garcia et al.

[11] Patent Number: 6,042,216

[45] Date of Patent: Mar. 28, 2000

[54] REPLACEABLE PRINTHEAD SERVICING MODULE WITH MULTIPLE FUNCTIONS (WIPE/CAP/SPIT/PRIME)

[75] Inventors: Jesus Garcia; Joan Carles Vives, both of Sant Cugat del Vallès, Spain; Brian Canfield, Encinitas, Calif.; Martin Urrutia, Sant Cugat del Vallès, Spain

[73] Assignee: Hewlett-Packard Company, Palo Alto, Calif.

[21] Appl. No.: 08/811,552

[22] Filed: Mar. 4, 1997

[51] Int. Cl.[7] ..... B41J 2/165

[52] U.S. Cl. ..... 347/29; 347/30; 347/33; 347/49

[58] Field of Search ..... 347/29, 33, 49, 347/36, 86, 87, 24, 30, 22

[56] References Cited

U.S. PATENT DOCUMENTS 5,155,497 10/1992 Martin et al. ..... 347/33

5,585,826 12/1996 Schroeder et al. ..... 347/29

FOREIGN PATENT DOCUMENTS

0362897A2 4/1990 European Pat. Off. .

0419876A1 4/1991 European Pat. Off. .

0590850A2 4/1994 European Pat. Off. .

0696507A2 2/1996 European Pat. Off. .

6-182987 7/1994 Japan ..... 347/29

*Primary Examiner*—N. Le
*Assistant Examiner*—Thien Tran
*Attorney, Agent, or Firm*—David S. Romney

[57] ABSTRACT

An inkjet printing system includes a replaceable printhead servicing module which incorporates multiple functions in a single unit. There is a separate servicing module associated with each different printhead, thus avoiding any contamination of either the printhead or the servicing module from interaction or mixing of different color inks. The servicing module includes a capper, a wiper, a spittoon, and a primer connection.

32 Claims, 19 Drawing Sheets

FIG. 6
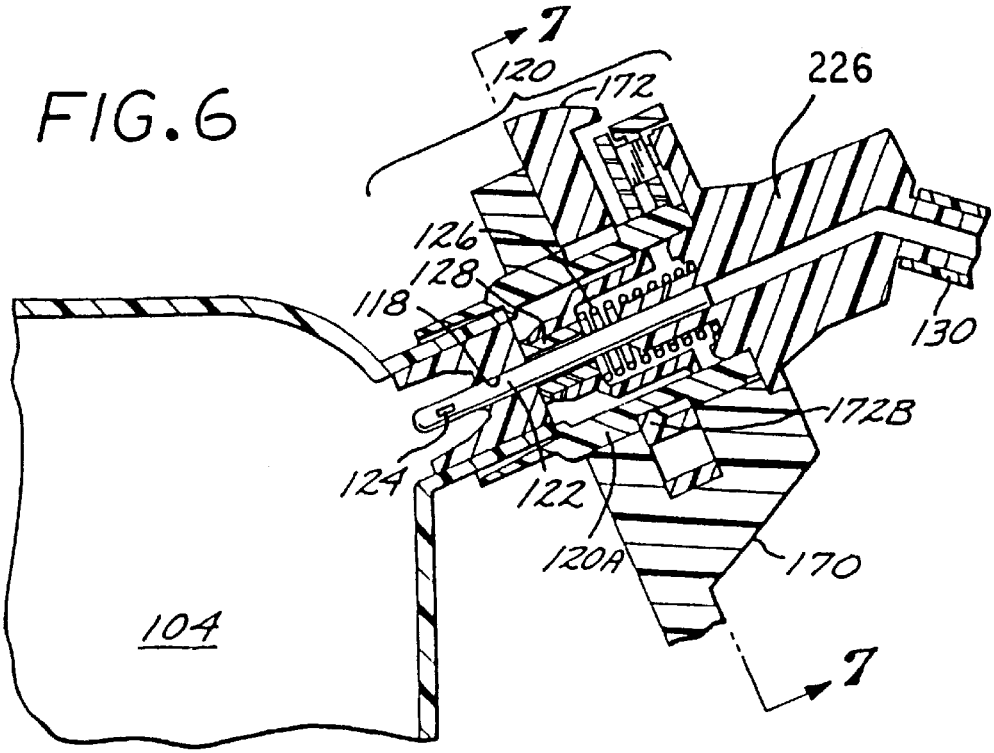
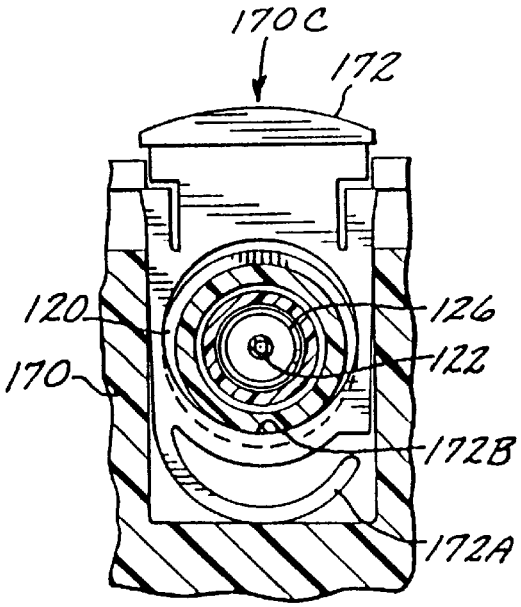
FIG. 7
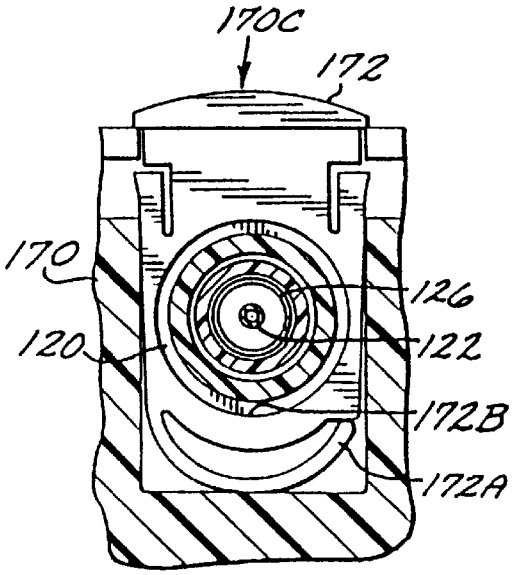
FIG. 8

REPLACEABLE PRINTHEAD SERVICING MODULE WITH MULTIPLE FUNCTIONS (WIPE/CAP/SPIT/PRIME)

CROSS-REFERENCE TO RELATED APPLICATIONS

A previously filed co-pending commonly assigned application related to this application is U.S. Ser. No. 08/454,975 filed May 31, 1995 by Joseph E. Scheffelin et al. entitled Continuous Refill of Spring Bag Reservoir In An Ink-Jet Swath Printer/Plotter, now U.S. Pat. No. 5,745,137, which is incorporated herein by reference.

Other more recent co-pending commonly assigned related applications are U.S. Ser. No. 08/726,587 filed Oct. 7,1996 by Robert Katon et al. entitled Inkjet Cartridge Fill Port Adapter, now U.S. Pat. No. 5,874,976; U.S. Ser. No. 08/810,485 filed Mar. 3, 1997 by Becker et al. entitled Inkjet Printing With Replaceable Set Of Ink-Related Components (Printhead/Service Module/Ink Supply) For Each Color Of Ink; U.S. Ser. No. 08/805,859 filed Mar. 3, 1997 by Zapata et al. entitled Replaceable Ink Supply Module (Bag/Box/Tube/Valve) For Replenishment Of On-Carriage Inkjet Printhead; U.S. Ser. No. 08/805,860 filed Mar. 3, 1997 by Coiner et al. entitled Space-Efficient Enclosure Shape For Nesting Together A Plurality Of Replaceable Ink Supply Bags; U.S. Ser. No. 08/810,840 filed Mar. 3, 1997 by Gunther et al. entitled Printing System With Single On/Off Control Valve For Periodic Ink Replenishment Of Inkjet Printhead, now U.S. Pat. No. 5,929,883; U.S. Ser. No. 08/805,861 filed Mar. 3, 1997 by De Olazabal et al. entitled Printer Apparatus For Periodic Automated Connection Of Ink Supply Valves With Multiple Inkjet Printheads; and U.S. Ser. No. 08/806,749 filed Mar. 3, 1997 by Young et al. entitled Variable pressure Control For Ink Replenishment of On-Carriage Print Cartridge, all of which are incorporated herein by reference.

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER" which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotters has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced applications describe certain features of this new ink delivery system.

BRIEF SUMMARY OF THE INVENTION

This invention optimizes the performance of this new off-carriage, take-a-gulp ink delivery system. In this type of IDS, a pen cartridge that uses an internal spring to provide vacuum pressure is intermittently connected to an ink reservoir located off the scanning carriage axis. Starting with a "full" pen cartridge, the printer will print a variety of plots while monitoring the amount of ink used. After a specified amount of ink has been dispensed, the pen carriage is moved to a refill station for ink replacement. In the refill station, a valve is engaged into the pen, thus connecting the ink reservoir to pen cartridge and opening a path for ink to flow freely. Using only the vacuum pressure present in the pen cartridge, ink is "pulled" into the pen from the reservoir.

An inkjet printing system includes a replaceable printhead servicing module which incorporates multiple functions in a single unit. There is a separate servicing module associated with each different printhead, thus avoiding any contamination of either the printhead or the servicing module from interaction or mixing of different color inks. The servicing module includes a capper, a wiper, a spittoon, and a primer connection.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

DETAILED DESCRIPTION OF THE PREFERRED EMBODIMENT

Figure 1:
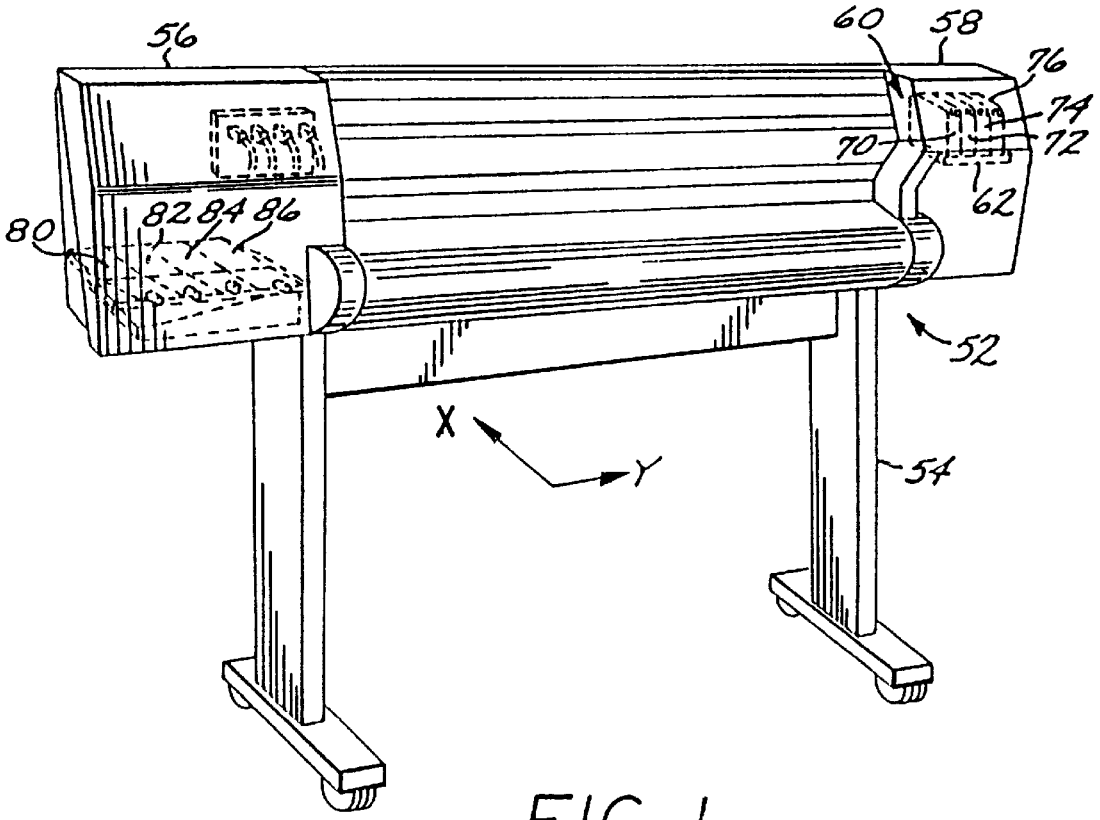
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage bar, shown in phantom under cover 58. A print medium such as paper is positioned along a media axis by a media axis drive mechanism (not shown). As is common in the art, the media drive axis is denoted as the 'x' axis and the carriage scan axis is denoted as the 'y' axis.

Figure 3:
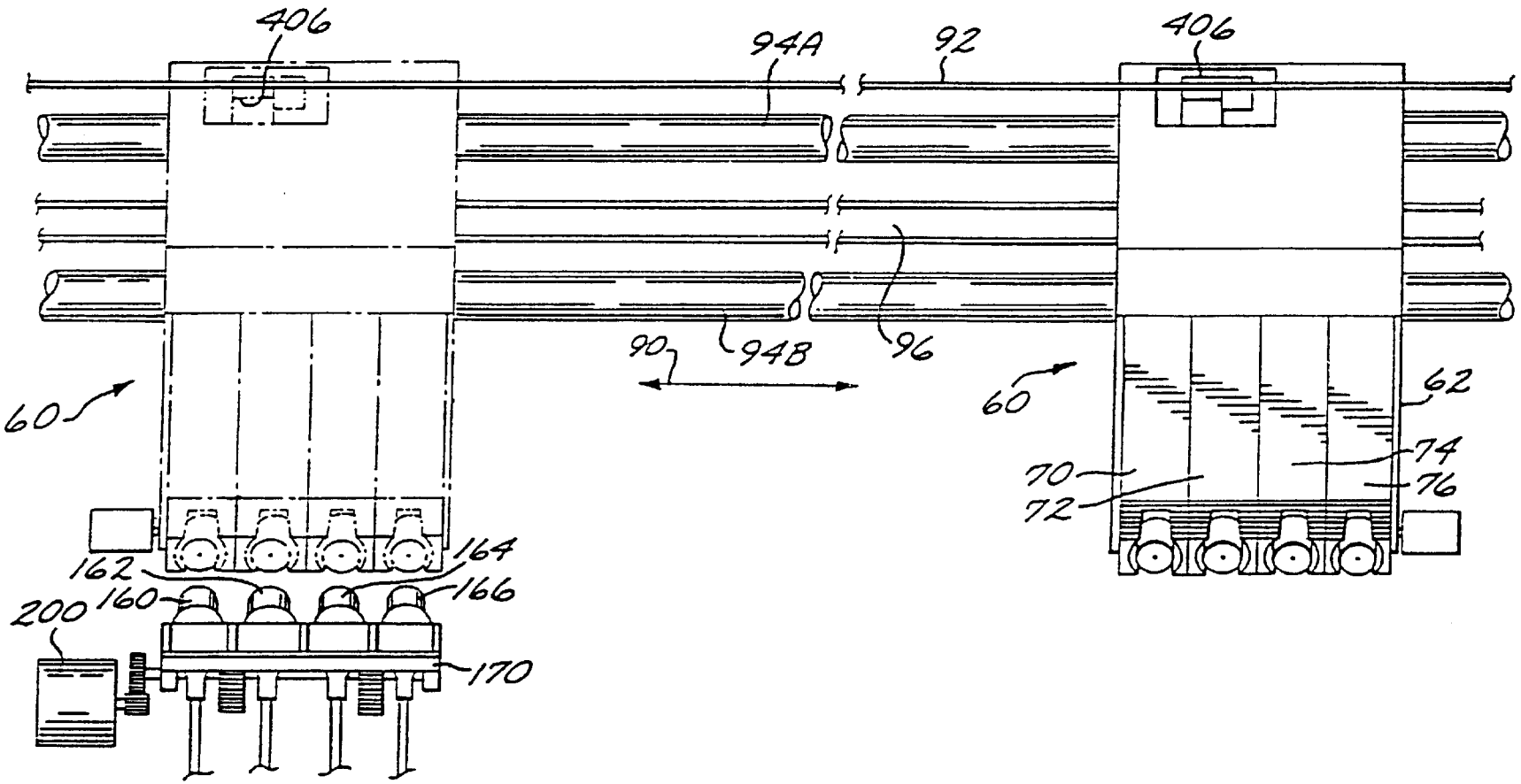
FIG. 3 is a top view showing the printer carriage and refill station.
Figure 4:
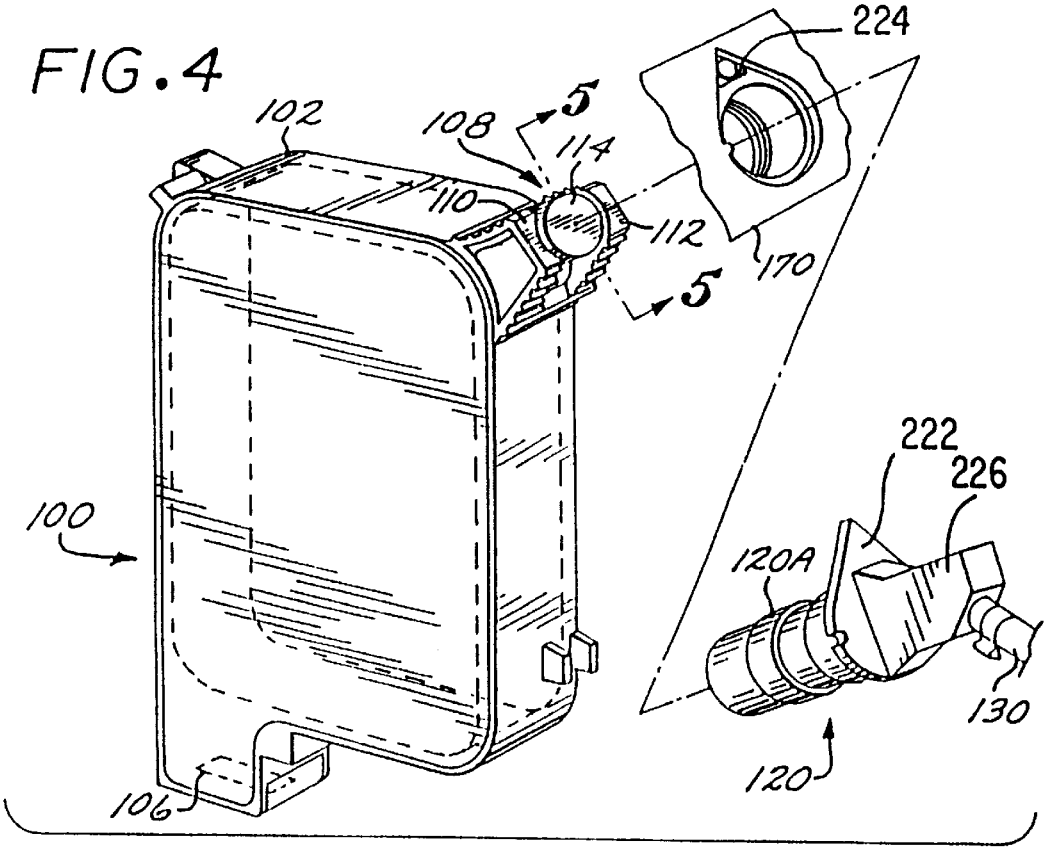
FIG. 4 is an isometric view of an ink-jet print cartridge usable in the system of FIG. 1, with a refill platform housing portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 15) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70, 72, 74, and 76 that store ink of different colors, e.g., yellow, cyan, magenta and black ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a head cleaner. The ink reservoir includes a bag holding 350 ml of ink, with a short tube and refill valve attached. Details of a ink reservoir bag structure suitable for the purpose are given in co-pending U.S. patent application Ser. No. 08/805,860, Attorney, SPACE-EFFICIENT ENCLOSURE SHAPE FOR NESTING TOGETHER A PLURALITY OF REPLACEABLE INK SUPPLY BAGS, filed Mar. 3, 1997 by Erich Coiner et al. These reservoirs are fitted on the left-hand side of the printer (behind the door of the left housing 58) and the valves attached to a refill arm 170, also behind the left door, as will be described below. The print cartridge in this exemplary embodiment includes a 300-nozzle, 600 dpi printhead, with an orifice through which it is refilled. The head cleaner includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 5 ccs of ink of any color).

The '975 application describes a negative pressure, spring-bag print cartridge which is adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a print operation. A protruding grip 108 extends from the housing enabling convenient installation and removal from a print carriage within an ink-jet printer. The grip is formed on an external surface of the housing.

Figure 5:
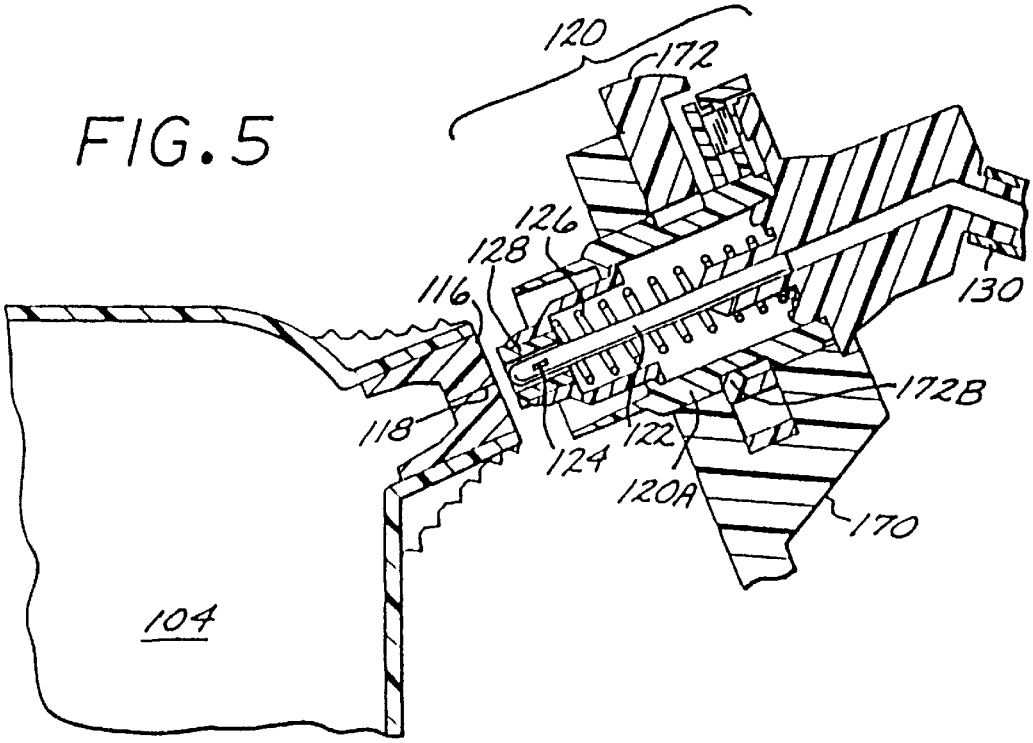
FIG. 5 is a cross-sectional view taken along line 5—5 of FIG. 4, showing the valve structure in a disengaged position relative to a refill port on the print cartridge.
Figure 9:
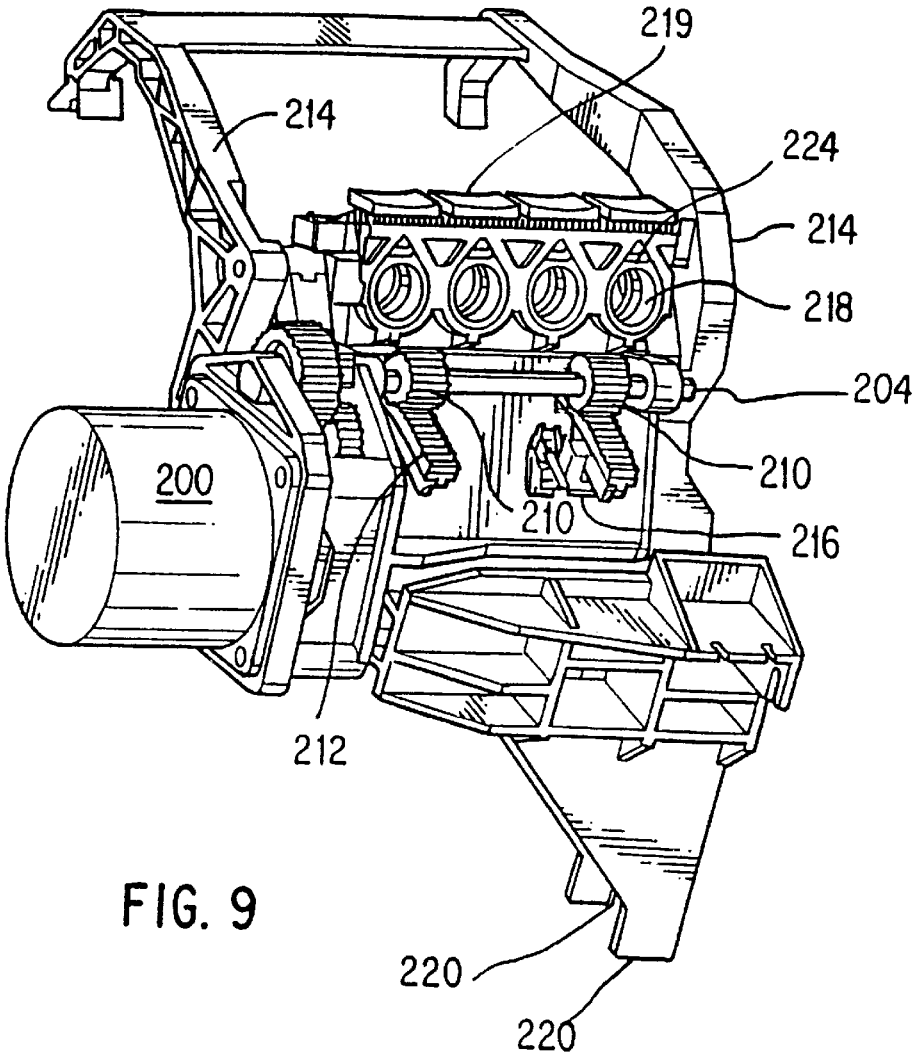
FIG. 9 is an enlarged view showing the mechanism for moving the valve structure, without any valves mounted thereon.

FIGS. 4–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 5 shows the valve structure 120 adjacent but not engaged with the port 116. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve collar 128 tightly fits about the needle, and is biased by a spring 126 to a valve closed position shown in FIG. 5. When the structure 120 is forced against the port 116, the collar is pressed up the length of the needle, allowing the needle tip to slide into the port opening 118, as shown in FIG. 6. In this position, ink can flow through the needle openings 124 between the reservoir 104 and the tube 130. Thus, with the cartridge 100 connected to an off-carriage ink reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-sealing refill port for the print cartridge.

FIGS. 4–8 illustrate a locking structure 172 for releasably locking the valve 120 into the refill arm 170 at socket 174. The structure 172 has locking surfaces 172B (FIG. 5) which engage against the outerhousing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application.

Figure 2:
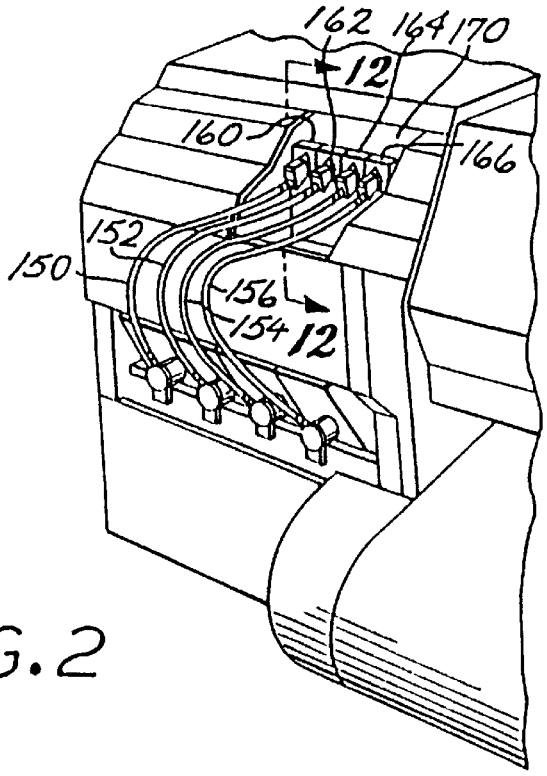
FIG. 2 is an enlarged view of a portion of the system of FIG. 1, showing the refill station.

In the exemplary system of FIG. 1, the refill platform 150 is in the left housing 56 of the printer 50 as shown in FIG. 2. The four off-carriage ink reservoirs 80–86 are supported on the platform 150. Short flexible tubes 152, 154, 156 and 158 connect between ports 80A–86A of corresponding reservoirs 80–86 and needle valve structures 160, 162, 164 and 166 supported at a refill station housing 170. These needle valve structures each correspond to the valve structure 120 of FIGS. 4–8.

The refill platform 150 is an elevator that holds the four reservoirs and can be moved up and down.

Figure 13:
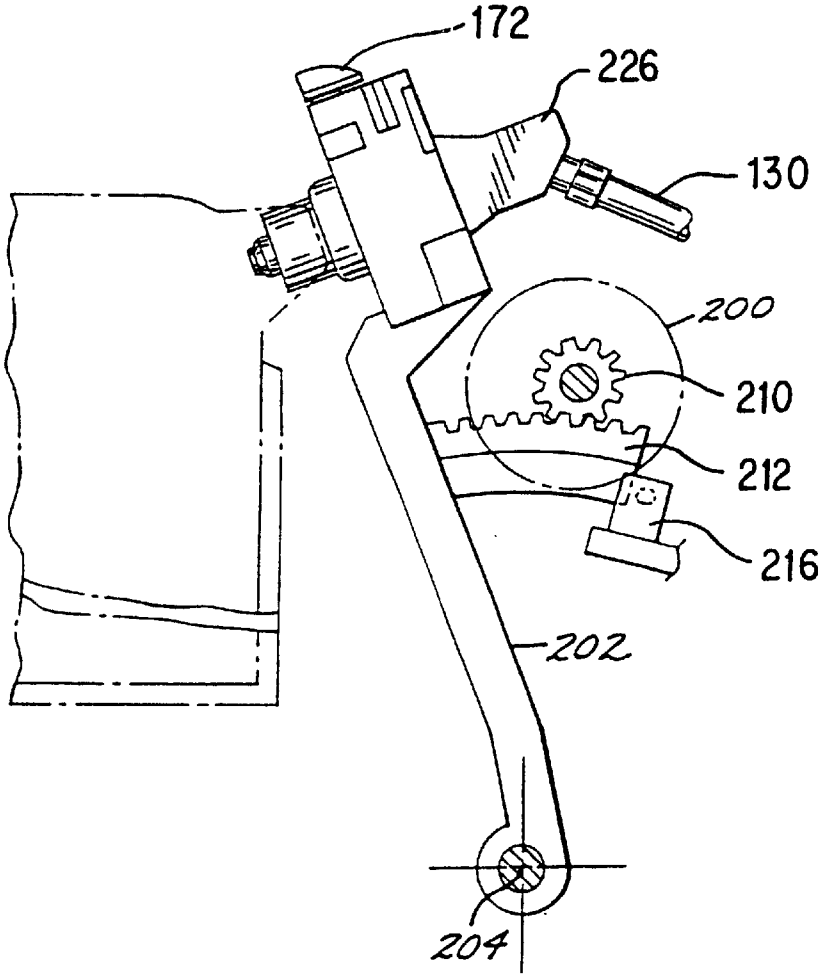
FIG. 13 is a detailed side view showing the mechanism for moving the valve structure in engaged position with a print cartridge.
Figure 12:
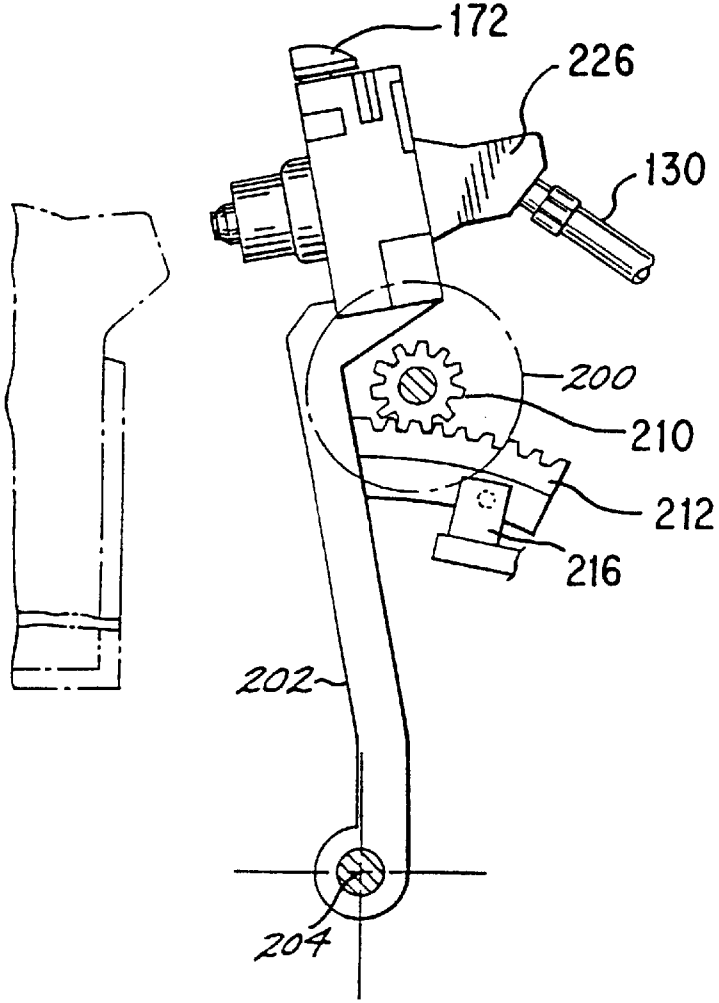
FIG. 12 is a detailed side view showing the mechanism for moving the valve structure in disengaged position with a print cartridge.

To perform a refill the carriage assembly 60 is moved to the refill station where the four off-carriage reservoirs 80–86 are connected to the corresponding print cartridges 70–76 via the shut-off valves 160–166. The connection of the reservoirs is accomplished by turning a stepper motor 200 that advances a lever 202 that rotates on axle 204 and on which the valve structures and refill station housing 170 are mounted, as shown in FIGS. 3 and 12–13. A system suitable for moving the valves into and out of engagement with the refill ports is more fully described in co-pending application Ser. No. 08/805,861 filed on Mar. 3, 1997, Attorney Docket No. 6096023, APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self regulating refill process where, as more ink is introduced into the print cartridge, the back pressure decreases to a point where the print cartridge can no longer pull additional ink into the cartridge and the refill stops. The pressure at which the flow of ink stops is governed by the distance offsetting the print cartridge and the off-carriage reservoir. The farther below the print cartridge the reservoir is located, the greater the final pressure in the print cartridge and the lower the resulting volume of ink in the print cartridge internal reservoir.

Figure 16:
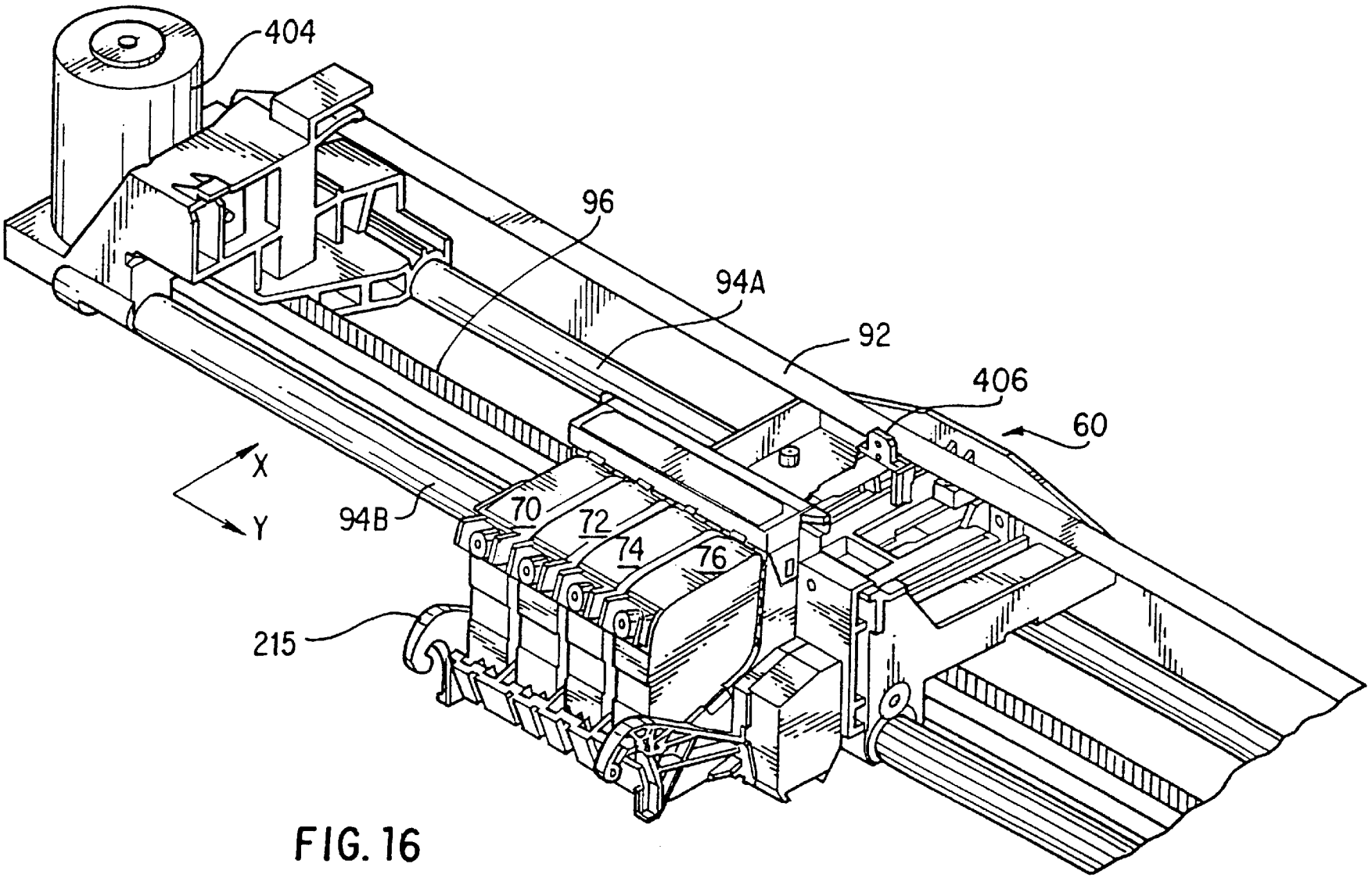
FIG. 16 is an isometric view of a carriage moving across a print zone.
Figure 17:
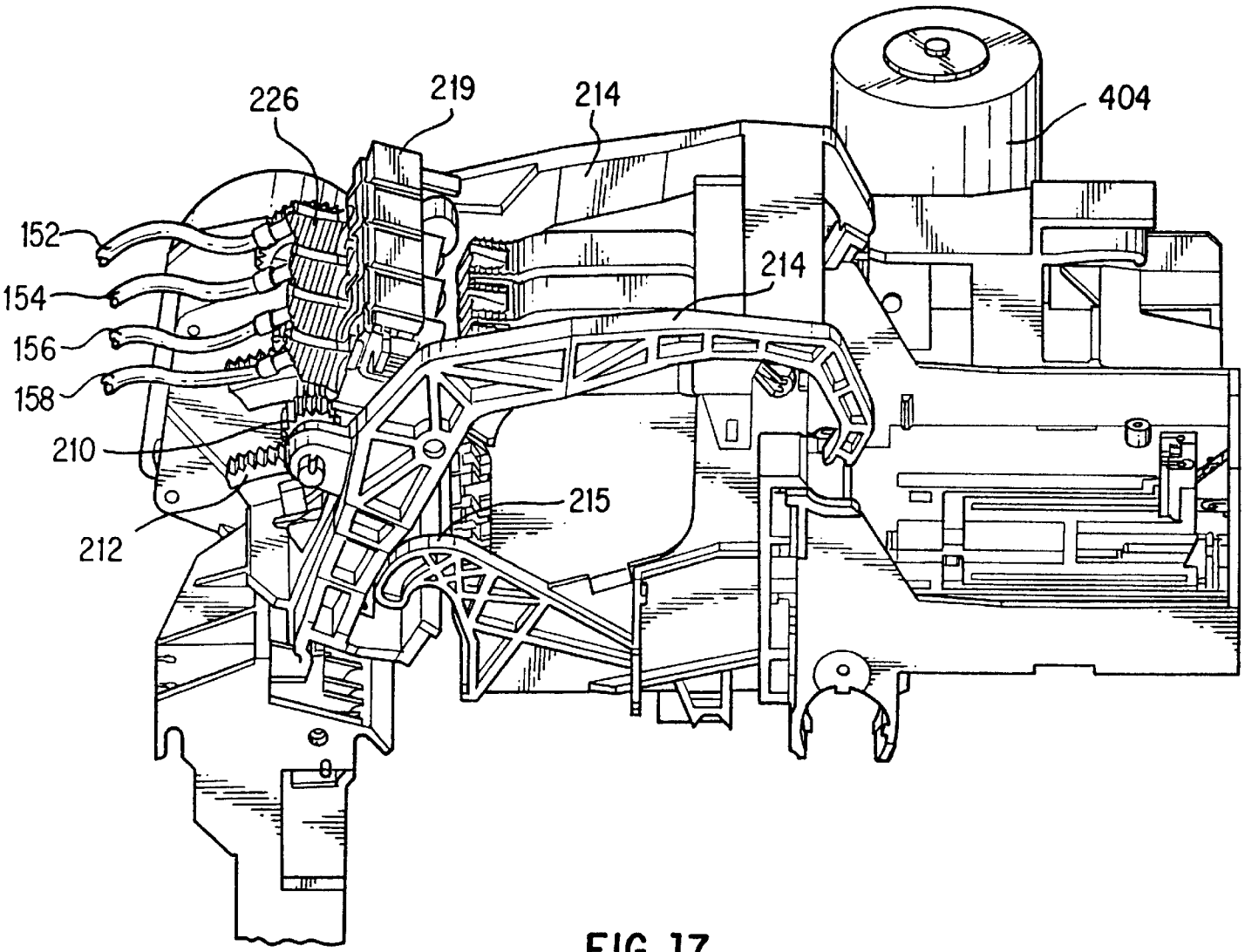
FIG. 17 shows the carriage of FIG. 16 in position at the refill station, with the valve structure in disengaged position.

As best shown in FIG. 16, the present invention does not require the specifications of the carriage to be redesigned due to the drag and interference that results from typical off-carriage ink systems where ink supply tubes remain constantly connected with the cartridges on the carriage during a printing operation. In contrast, the carriage shown in the drawings can move back and forth across the print zone without any supply tube connection whatsoever. Moreover, there is no need to account for the additional carriage mass that typically results from having a replaceable supplemental ink supply mounted directly on the carriage.

Additional details of the apparatus which provides the periodic connection/disconnection at the refill station between the print cartridge fill port and the off-carriage ink supply valve will now be described. Referring to FIGS. 9, 12–13 and 17, a bracket holding the ink supply valves supports the motor 200 which turns gears 210 to move gear arms 212 back and forth between a position of engagement of the supply valves with their respective fill ports on the print cartridges, and a position of disengagement. Primary stabilizing arms 214 on the bracket as well as secondary stabilizing arms 215 on the carriage provide the necessary restraint required to minimize an undue stress on the cartridges which might otherwise displace their precise positioning in the carriage. The beginning and end points of the engagement/disengagement are defined by an optical sensor 216.

In the presently preferred embodiment of the invention, all four ink supply valves move together as a unit as they are held in fixed position in their apertures 218 by individual locking buttons 219 that allow each valve to be separately replaced whenever the expected life of the integrated IDS has expired for that particular color of ink. When replacement is required, an arrow-shaped orientation key 222 mates with a matching orientation slot 224 by easy manual manipulation through a valve handle 226.

Figure 14A:
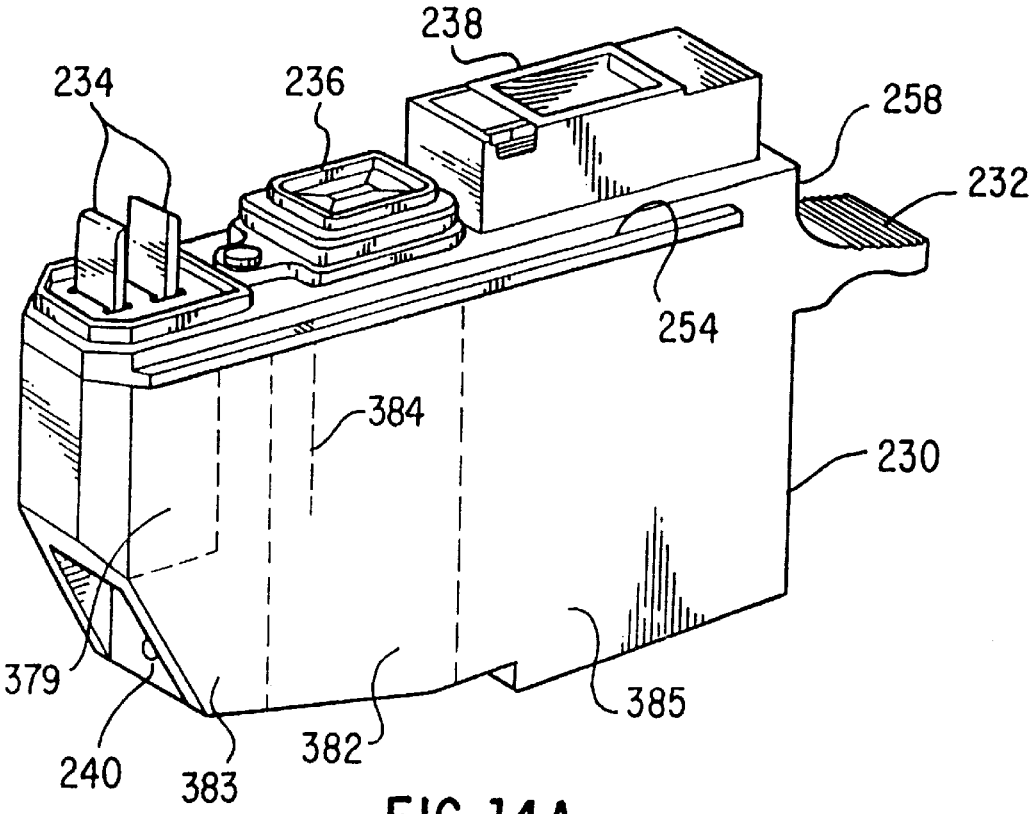
FIGS. 14A and 14B show an isometric and a side view, respectively of a service station module incorporating the present invention.
Figure 14B:
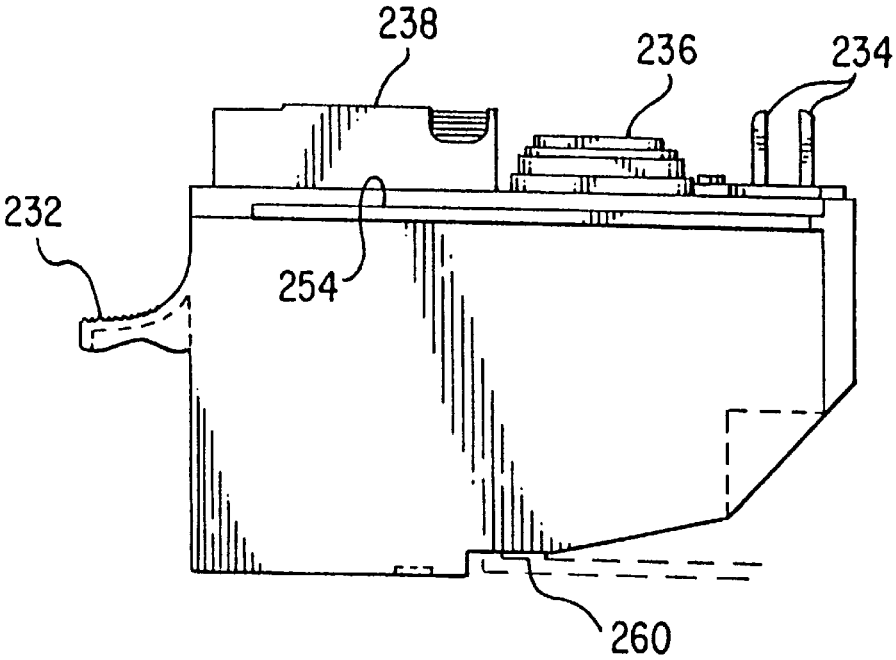
Figure 15:
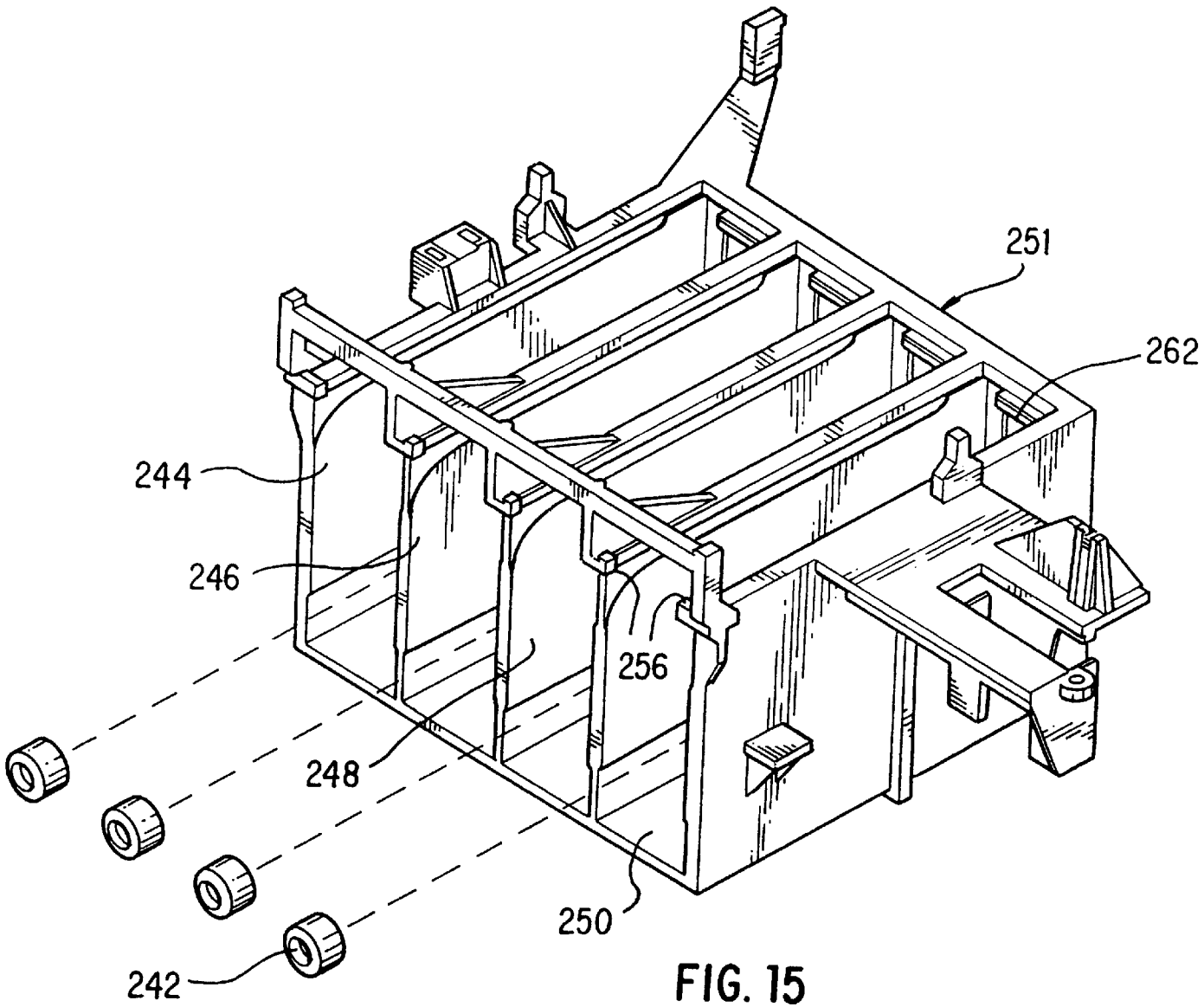
FIG. 15 is an isometric view of a carriage for removably mounting the service station module of FIGS. 14A–14B.

A unique narrowreplaceable service station module 230 for each color ink is an important part of the IDS. Referring to FIGS. 14A–14B and 15, this service station module includes a protruding handle 232 on one end, and a group of printhead servicing components which are combined together in a relatively small area on top of the module. At one end are dual wipers 234 and at the other a spittoon 238 with a nozzle plate cap 236 at an intermediate position. An external primer port 240 in the module is connected through an interior passage to the cap 236, and in the opposite direction through a circular seal 242 to a vacuum source. A service station carriage 251 includes separate slots 244, 246, 248, 250 for each service station module (also sometimes called a printhead cleaner).

A spring-loaded datum system provides for the service station module to be easily but precisely positioned in the service station carriage. Along a top portion of each slot is a z-datum ridge 252 which engages a corresponding datum ledge 254 along both top edges of the module. An upwardly biased spring art 260 assures a tight fit along these datum surfaces. A horizontal positioning is provided in each slot by a pair of protruding corners which act as latches against matching stops 258 on the module. Although not required, a biasing arm 262 may be employed in a rear wall of each slot.

Figure 10:
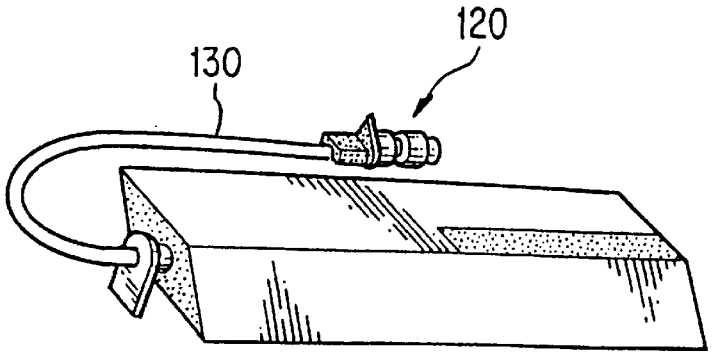
FIG. 10 shows an off-carriage ink supply module incorporating the present invention.
Figure 11:
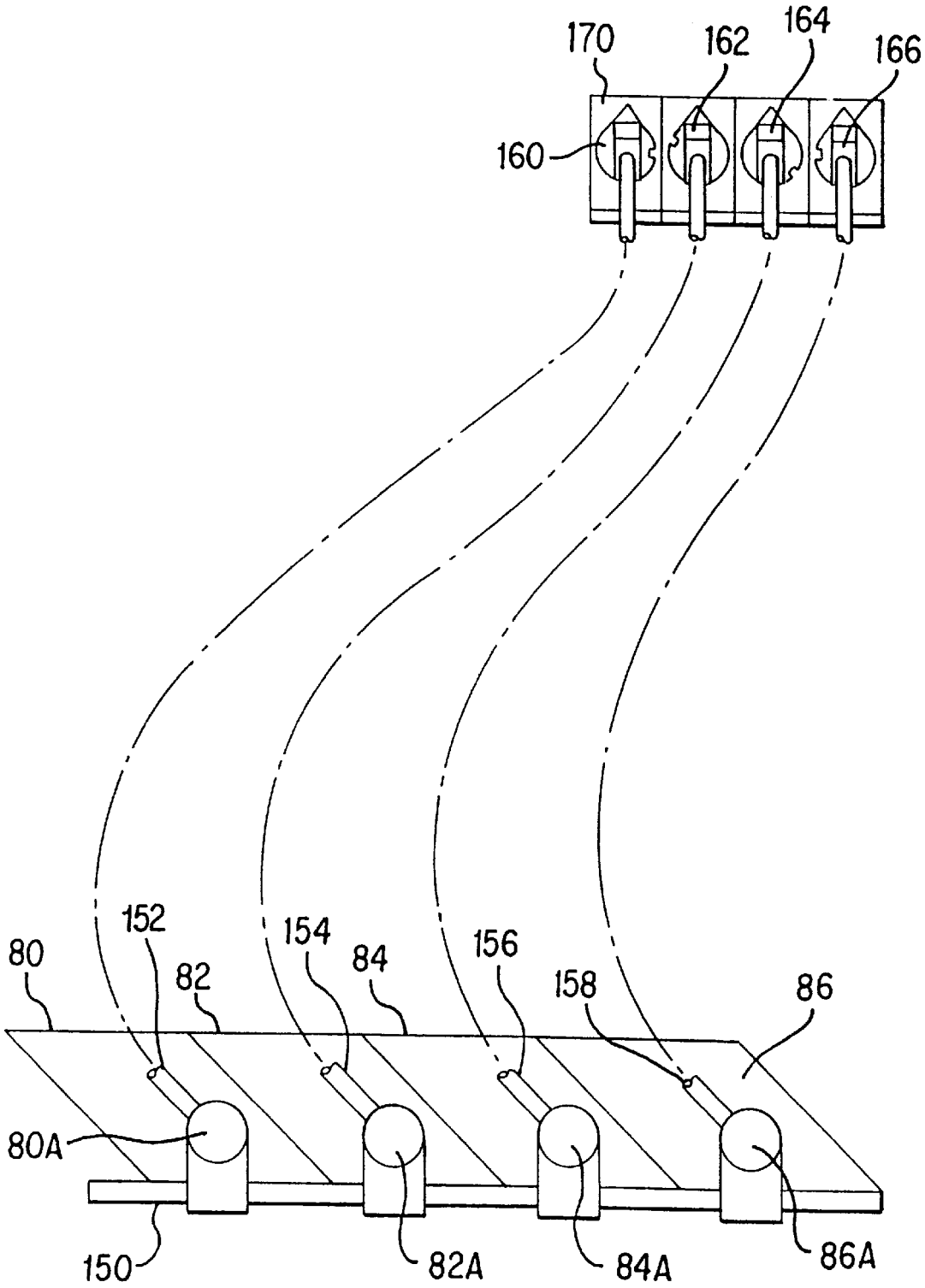
FIG. 11 is a schematic representation showing a plurality of off-carriage ink supply modules connected to the valve structure.

FIG. 10 shows the basic exterior structure of an ink supply module before installation, and FIG. 11 shows how four such modules are grouped together on a refill platform on the printer with their valves manually installed on the valve bracket.

Figure 18A:
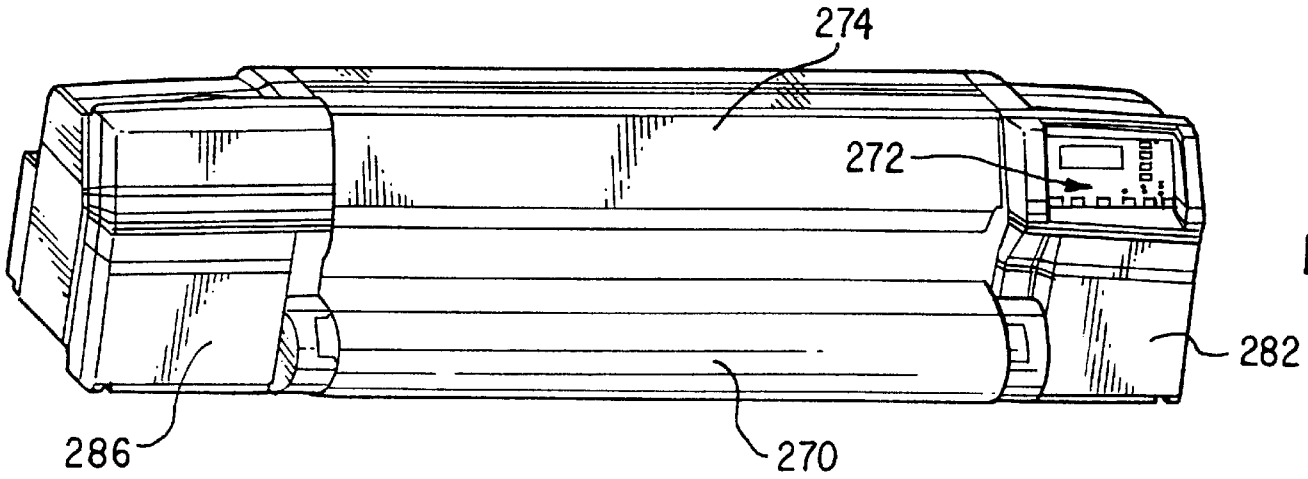
FIGS. 18A and 18B show the printer with the refill station and service station doors in closed and open positions, respectively.
Figure 18B:
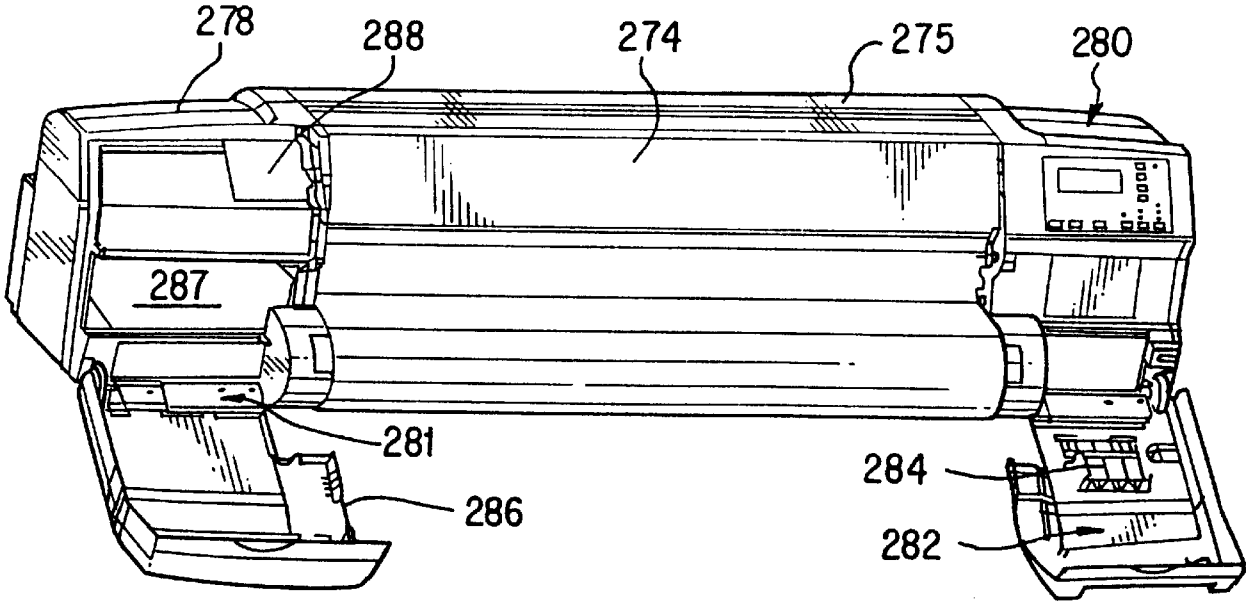
Figure 19:
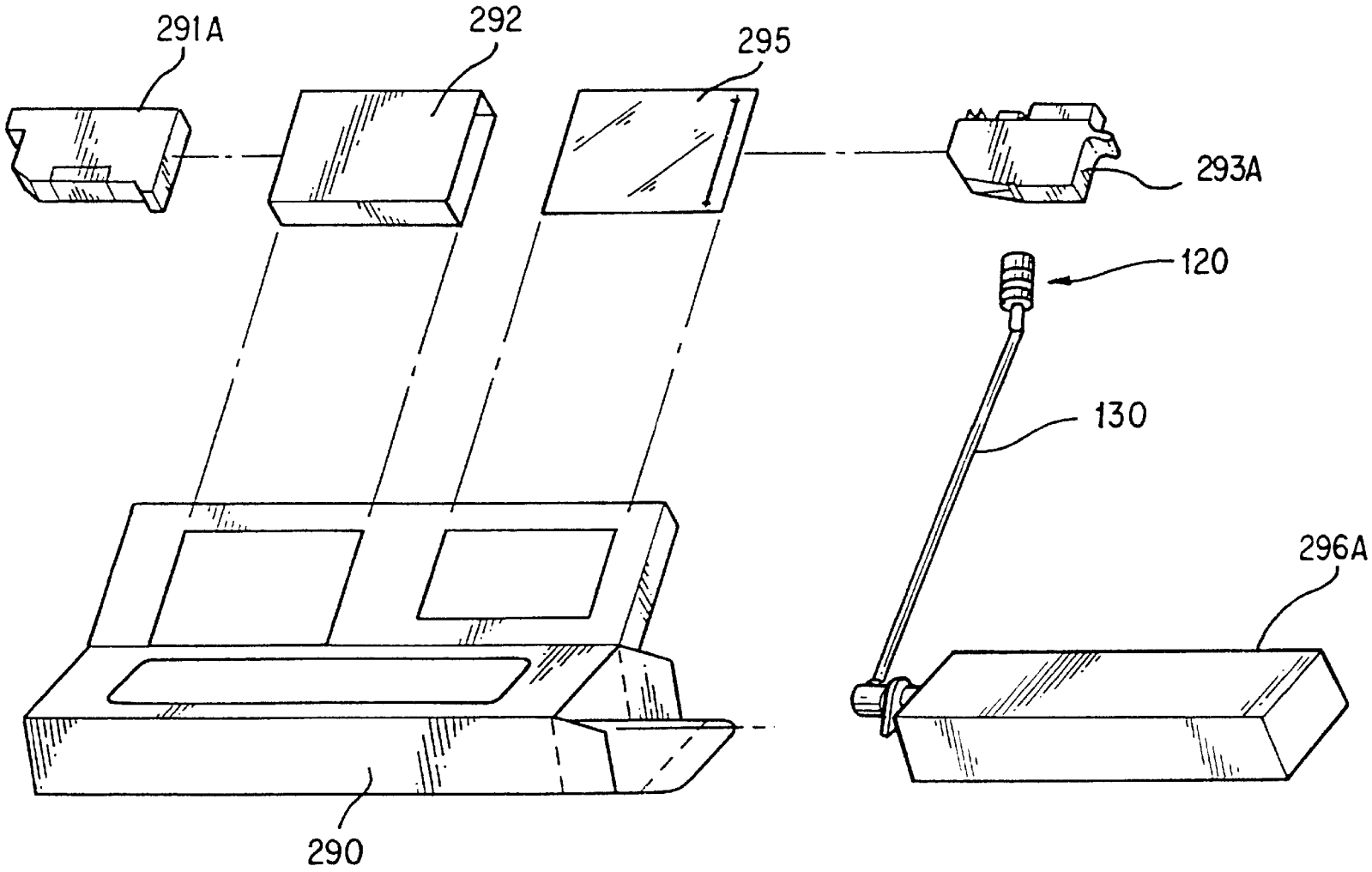
FIG. 19 is an exploded schematic view showing the integrated ink delivery system component of the invention (print cartridge, ink supply module and service station module) incorporated into a single package.
Figure 20:
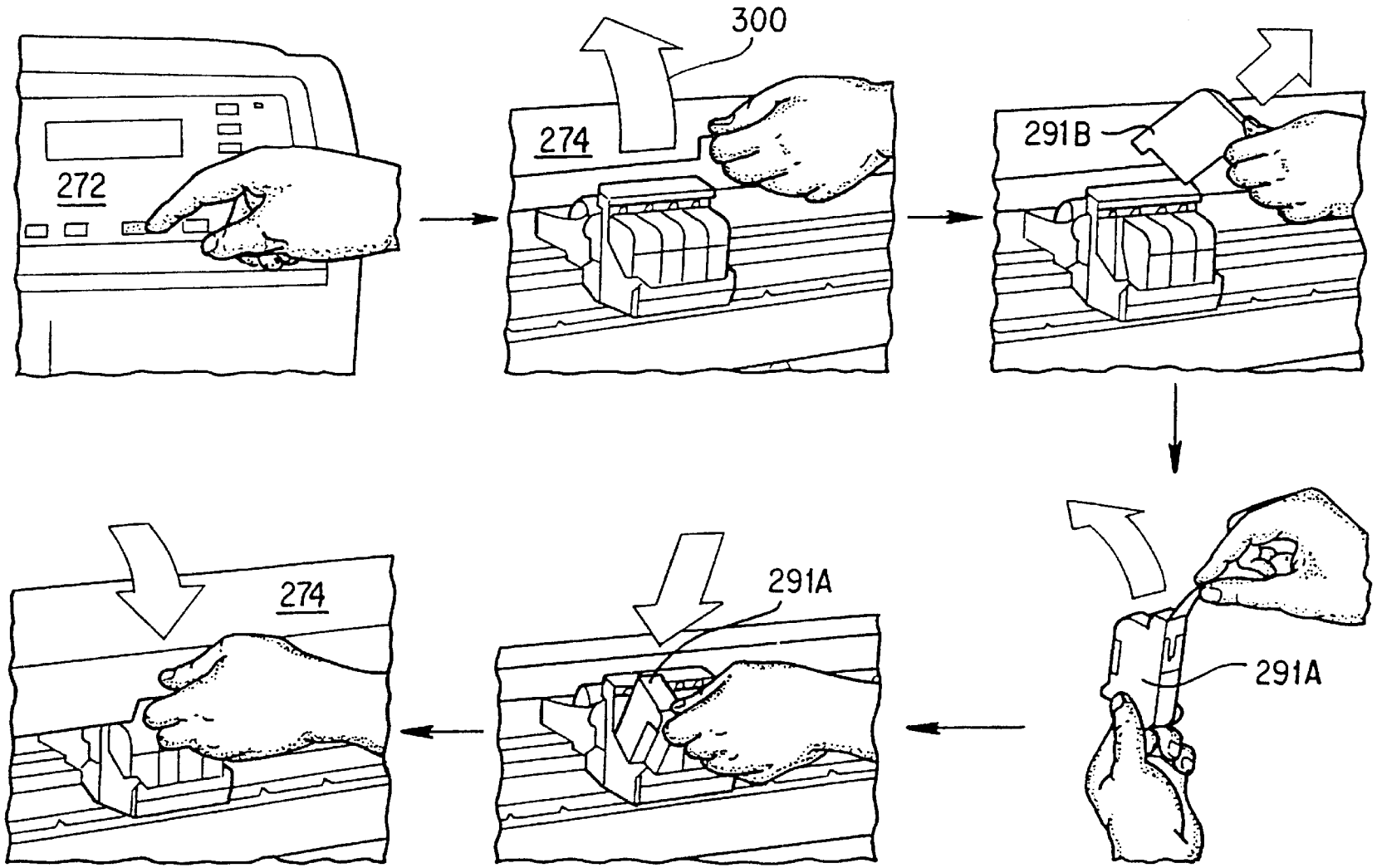
FIG. 20 shows six exemplary steps for replacing the print cartridge of the present invention.
Figure 21:
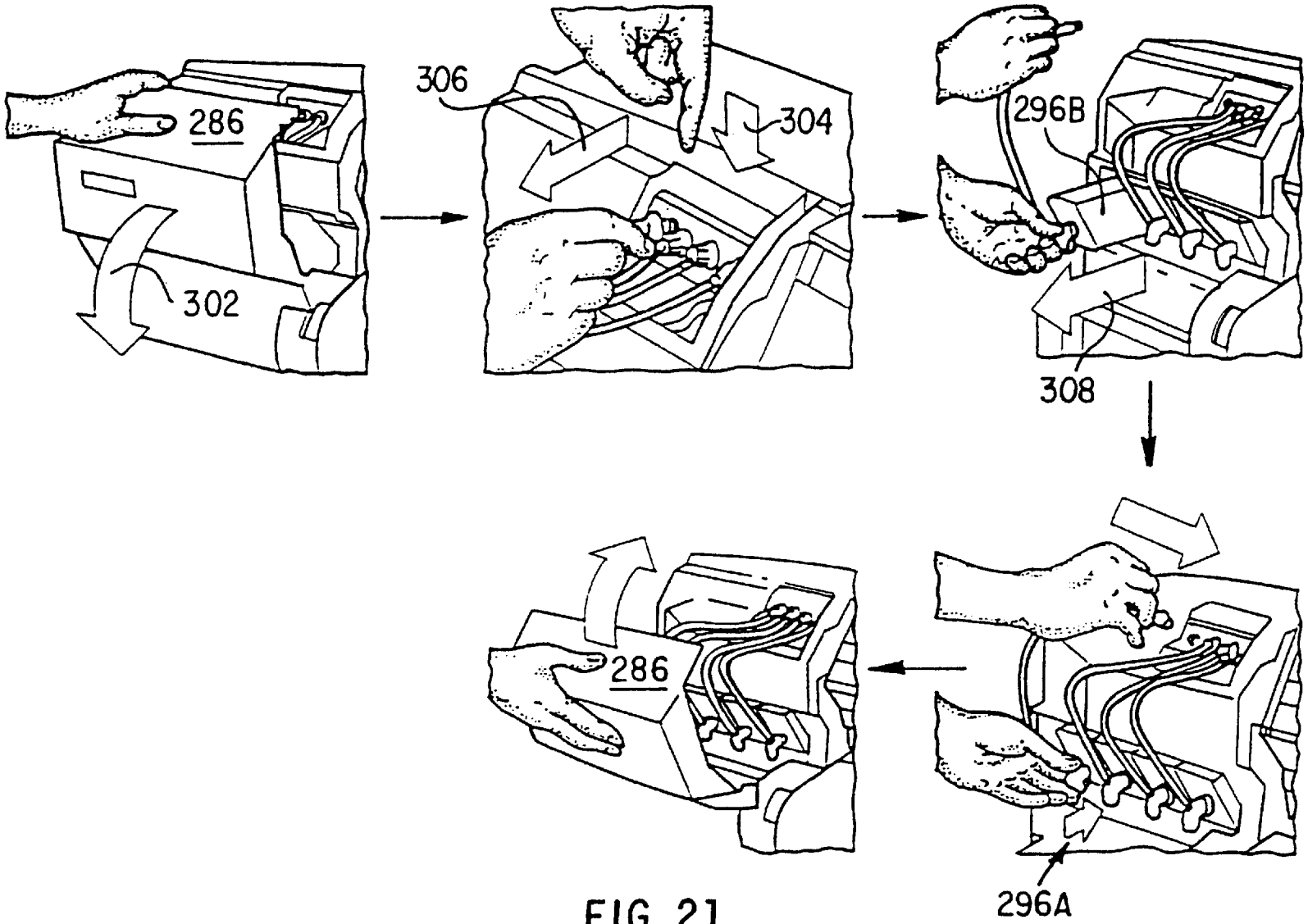
FIG. 21 shows five exemplary steps for replacing the ink supply module of the present invention.
Figure 22:
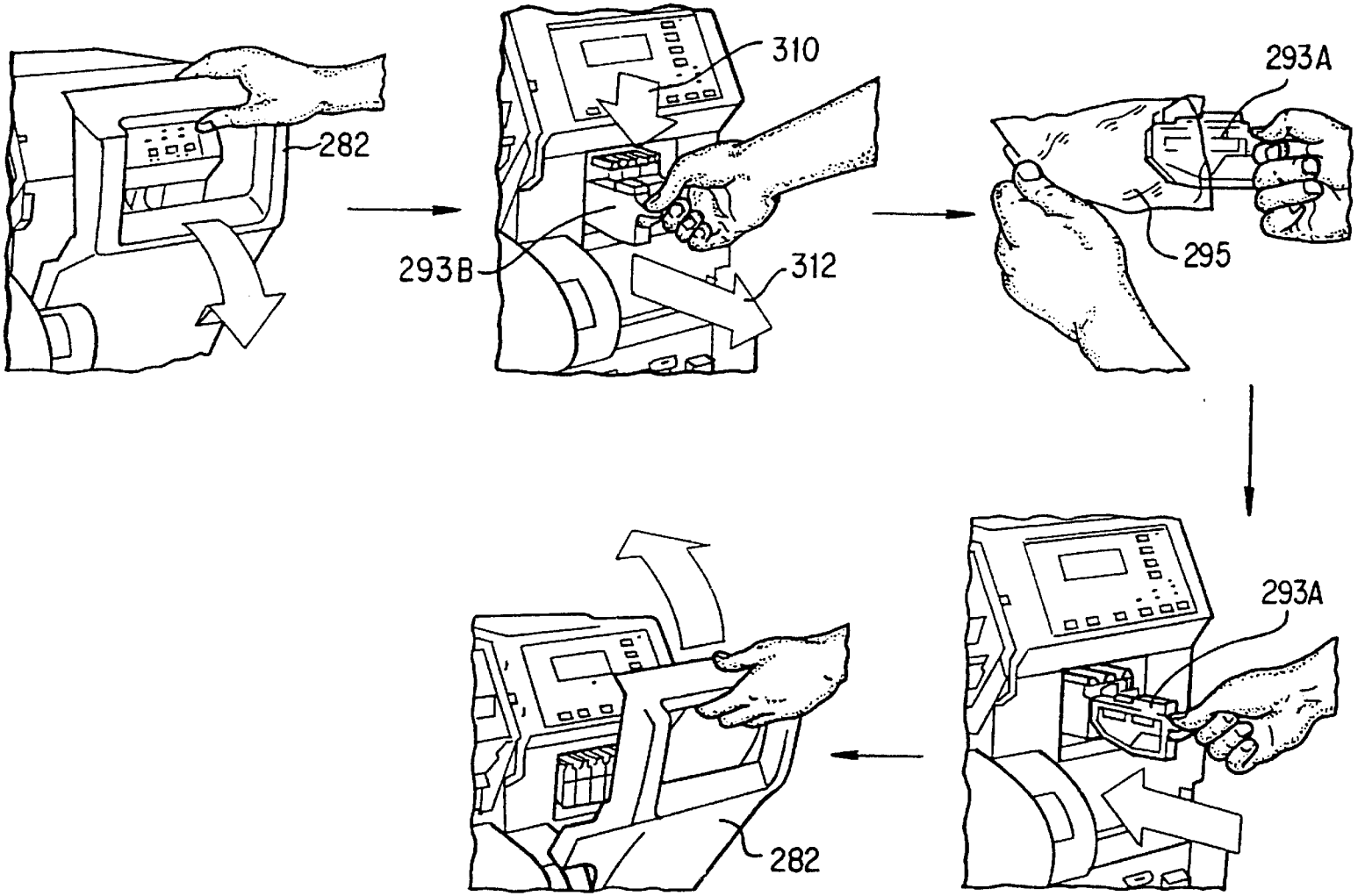
FIG. 22 shows five exemplary steps for replacing the service station module of the present invention.

FIGS. 18A and 18B illustrate the accessability required for replacement of the three basic components parts of the IDS. The front of the printer unit typically includes a roll feed unit 270, a control panel 272 and a print zone access door 274 adjacent an elongated frame member 275. The service station is located at the right end of the carriage scan axis, and a refill station 278 at the opposite end. Simple friction latches such as indicated at 280 are provided to assure proper closure of doors which are mounted on pivot hinges such as 281. A pusher plate 284 contacts and helps to position any incompletely mounted service station modules upon closure of a service station access door 282. A similar door 286 closes off the refill station during normal operation of the printer. The refill station includes space 287 for an ink supply platform, and an access hole 288 from the platform to carriage-mounted printheads.

An installation procedure will now be described in conjunction with FIGS. 19–22. An ink delivery system is preferably packaged as a unit in a carton 290 which holds a new print cartridge 291A, a new service station module 293A in a plastic storage bag 295, and a new ink supply module 296A. As shown in the self-explanatory sequence of drawings of FIG. 20, an old print cartridge 293A is easily removed and replaced with a new one 291A, after actuating a button on the control panel 272 and opening the print zone access door 274 as shown by arrow 300. As shown in the self-explanatory sequence of drawings of FIG. 21, a depleted ink supply module 296B is removed without difficulty by first opening the ink door 286 as shown by arrow 302, then pushing down on the lock button as shown by arrow 304 and at the same time pulling out the valve as shown by arrow 306 and then removing the ink supply module 296B from the printer as shown by arrow 308. The depleted ink module 296B can then be replaced with a new ink supply module 296A and then the ink door 286 is closed. Finally as shown in the self-explanatory sequence of drawings of FIG. 22, after the service station access door 282 is opened a user can push down on the handle in the direction shown by arrow 310 thereby dislodging an old service station module 293B, and then pull it out all the way as indicated by arrow 312, followed by installation of a new service station module 293A.

Accordingly it will be appreciated by those skilled in the art that the basic features of the unique take-a-gulp ink replenishment system of the present invention provides a unique but relatively simple way of providing for unattended printing through automated ink replenishment. Furthermore, all ink-related components can be replaced for a particular color of ink by a user, without the need of special tools and without the need of calling a specialized service person.

Figure 23:
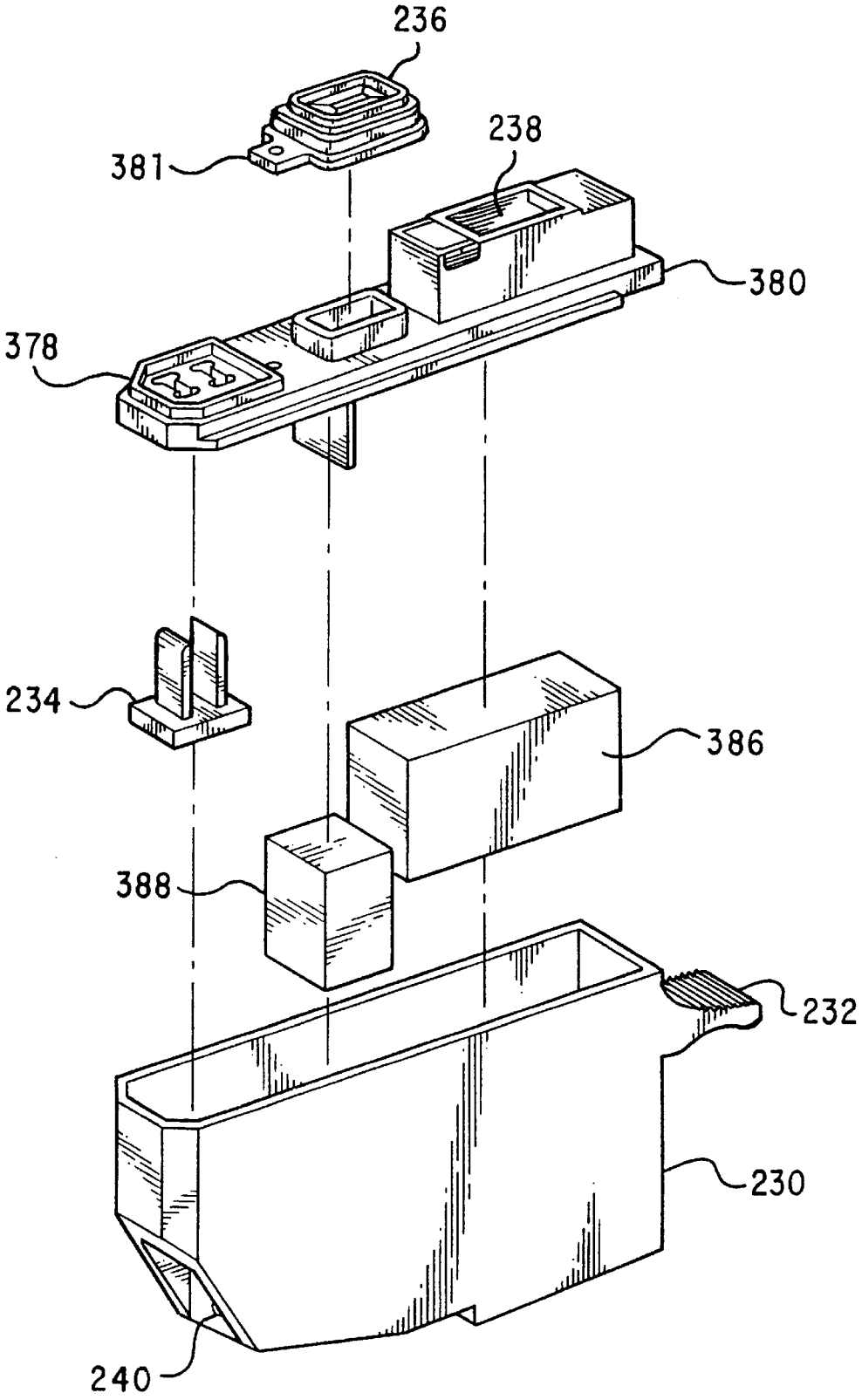
FIG. 23 is an exploded isometric view of the service station module of FIGS. 14A–14B.

Additional details of the service station module 230 are shown in FIG. 23 in conjunction with FIGS. 14A–14B. A unitary body portion defines various internal chambers and passages as well as providing a support for a top plate 380 which extends all the way across a top opening in the body portion. The spittoon 238 is in a raised position at one end of the top plate. The cap 236 is positioned and secured on the top plate with the help of a mounting tab 381, and both wipers 234 are incorporated in a single unitary part also mounted on the top plate. A drain 378 next to the wipers feeds ink from the wipers into a waste chamber 379 located in the body portion.

The primer port 240 connects through passages in the body portion to the cap. A main ink collection chamber 382 is directly under the cap and is separated from a secondary chamber 383 by a baffle 384 extending down from the top plate. In order to help prevent undue ink buildup, a larger absorbent foam block 386 is employed in the bottom of a spittoon collection chamber 385 and a similar smaller absorbent foam block 388 is placed in the bottom of the chamber 382.

Figure 24:
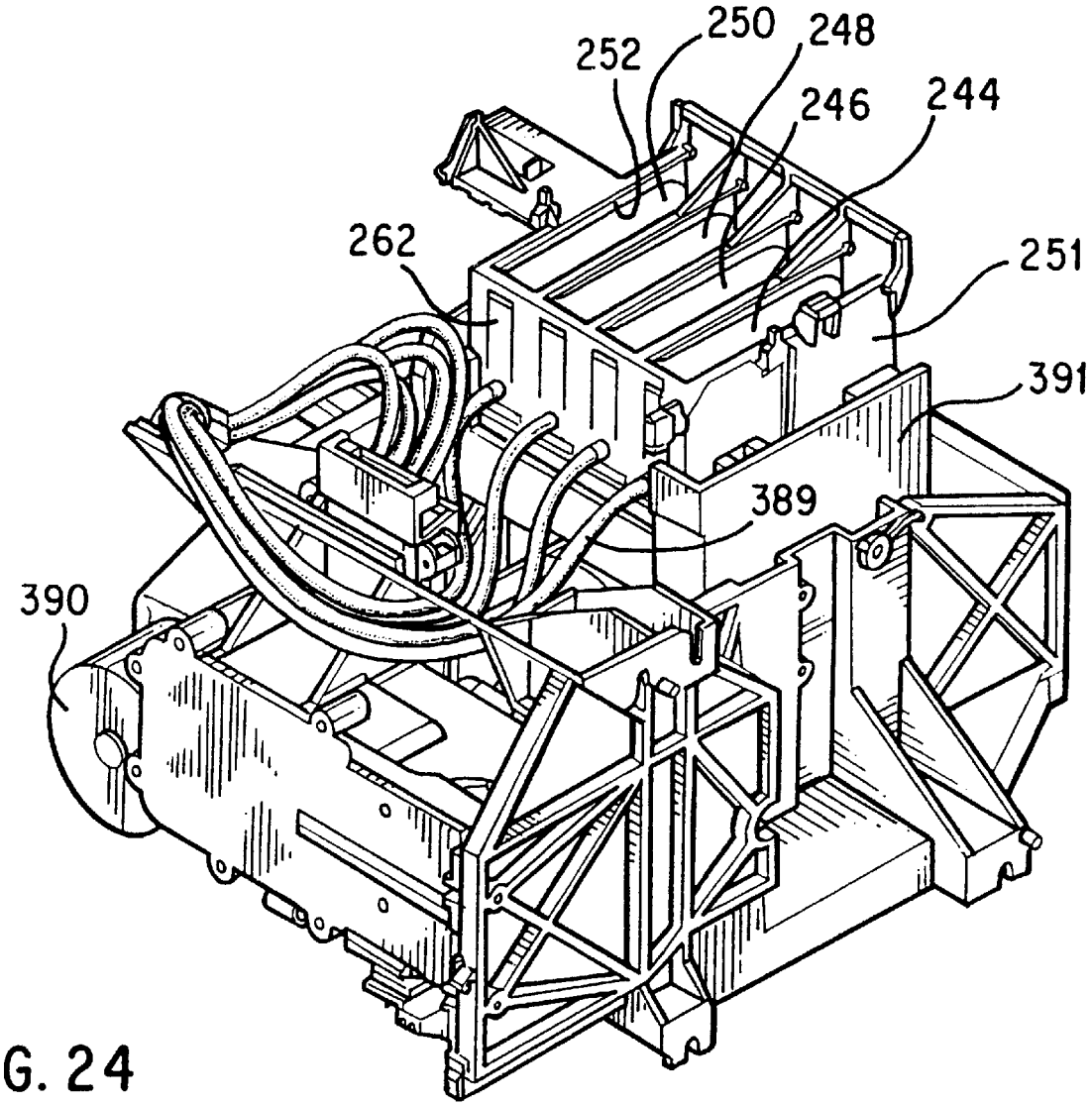
FIG. 24 is an isometric view looking down at the back of a service station unit with a service station carriage installed thereon for utilizing the service station module of FIG. 23.
Figure 25:
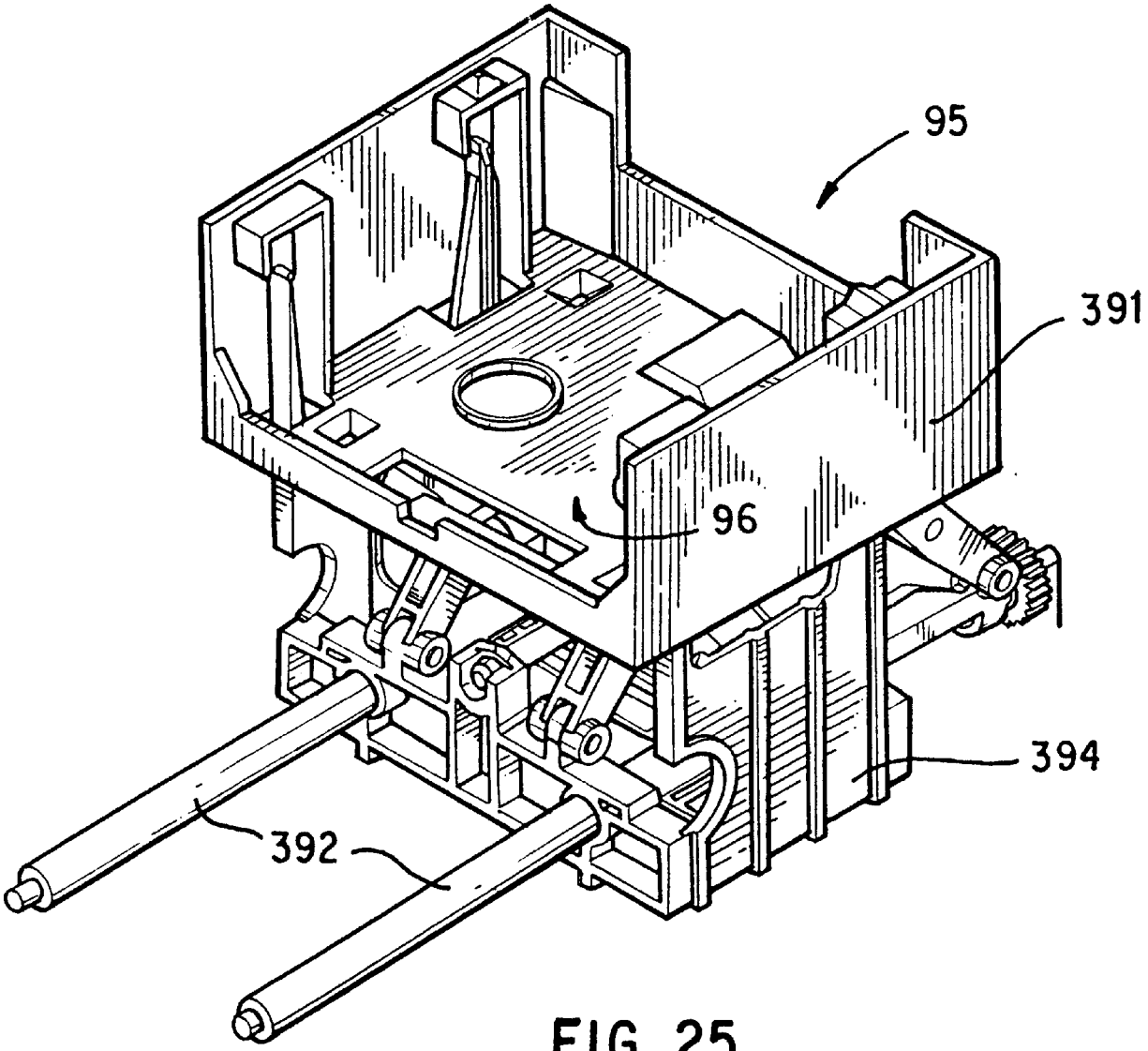
FIG. 25 is an isometric view looking down at a front portion of the service station unit of FIG. 24, without any carriage installed.

Additional details of the service station mechanism on the printer are shown in FIGS. 24–25. The service station carriage 251 has primer tubes 389 attached from the rear to the respective primer ports 240. A motor 390 is provided to move a platform 391 along slide rods 392 as part of various servicing operations as well as to position the carriage for installation or removal of individual modules by a user. The entire service station mechanism is supported by a chassis 394, and the platform includes a rear access 95 for the primer tubes 389 as well as a front access 96 to facilitate the aforementioned installation or removal of individual modules from the service station carriage.

It is to be understood that certain features of the service station module and the service station carriage are optional and are not required in order to obtain the benefits of the invention. For example, the foam inserts are helpful but not required in order in the ink collection chambers inside of the service station module. Similarly, while some form of restraint is desirable to assure secure positioning of the module in the carriage, it is not necessary to have positive biasing forces in all of the X, Y and Z axis directions. In a currently preferred form, only a biasing spring in the Z axis direction is to be employed in a proposed commercial embodiment of the invention, thus relying on a somewhat snug mechanical fit in the other axis directions. Also, such spring need not be a plastic extension of the carriage as presently used in a preferred embodiment, but could be a separate spring of different material. And other holding techniques could also be employed rather than a spring in order to stabilize the service station component sufficiently to perform its various functions relating to the cleaning, maintenance, enhancement and protection of the printhead.

Thus, once the service station modules are securely positioned in the service station carriage, all of the various important servicing functions (wiping, capping, priming, spitting, or selected sub-groups thereof) required for reliable operation of an inkjet printhead can be done in conjunction with a single module or cleaner which is dedicated solely to a single printhead and which can be removed and replaced at the same time that the associated printhead is removed. Thus the coordination of expected life of the service station module, ink supply module and printhead is an important feature of the invention. When a different ink supply such as UV ink for outdoor usage is required, an entire ink delivery system (including ink and ink-related components) can be easily replaced.

While a preferred embodiment of the invention has been shown and described, it will be appreciated by those skilled in the art that various modifications can be made without departing from the spirit and scope of the invention as defined by the following claims.

We claim as our invention:

1. An inkjet printhead service module, for use with an inkjet printing apparatus including a plurality of print cartridges, comprising:

a central body including a top portion, side walls, and a bottom for housing and carrying a plurality of ink-related maintenance components including a cap for servicing an individual printhead of a predetermined one of the plurality of print cartridges, said central body manually installable and removable from a printer without affecting maintenance components for servicing other of the plurality of print cartridges; and wherein said cap is located on said central body for engagement with a nozzle plate of said individual printhead at a time when the print cartridge is not printing.

2. The service module of claim 1, said maintenance components further including a wiper on said central body for engagement with the nozzle plate of the printhead.

3. The service module of claim 2, said maintenance components further including a spittoon on said central body for receiving ink ejected from said nozzle plate during non-printing operation of the printer.

4. The service module of claim 2, said maintenance components further including a primer connection on said central body for communication with said nozzle plate of the printhead.

5. The service module of claim 4, said maintenance components further including a spittoon on said central body for receiving ink ejected from said nozzle plate during non-printing operation of the printer.

6. The service module of claim 2 which includes a first ink chamber under said wiper for collection of residual ink resulting from engagement of said wiper with said nozzle plate.

7. The service module of claim 1, said maintenance components further including a spittoon on said central body for receiving ink ejected from said nozzle plate during non-printing operation of the printer.

8. The service module of claim 7 which includes a second ink chamber under said spittoon for collection of residual ink resulting from ink rejected from said nozzle plate during non-printing operation of the printer.

9. The service module of claim 8 which further includes a foam member inside said second ink chamber.

10. The service module of claim 1, said maintenance components further including a primer connection on said central body for communication with said nozzle plate of the printhead.

11. The service module of claim 10 which includes a third ink chamber in communication with said primer connection for collection of residual ink resulting from a priming of said printhead during non-printing operation of the printer.

12. The service module of claim 10 which includes an external connecting port for establishing fluid communication between a primer vacuum device and said primer connection.

13. An inkjet printer comprising:

a printer carriage;

a printhead service module which is removably mountable on the printer;

a plurality of print cartridges on said printer carriage, such that said printhead service module provides independent servicing functions for a predetermined individual printhead of said plurality of print cartridges without providing such servicing functions to other printheads on said printer carriage; and wherein said printhead service module includes a body portion having multiple chambers therein;

a wiper on said body portion for maintenance of a nozzle plate on said individual printhead of the print cartridge;

a cap for protecting said nozzle plate during periods of non-operation of the printer; and a primer passage for providing a partial vacuum to activate said individual printhead.

14. The inkjet printer and printhead service module of claim 13 which also includes a spittoon on said body portion.

15. The inkjet printer and printhead service module of claim 13 which includes a gripping handle on said body portion.

16. The inkjet printer and printhead service module of claim 13 wherein said primer passage is connected to said nozzle plate through said cap.

17. The inkjet printer and printhead service module of claim 13 wherein said wiper and said cap are located on a top of said body portion.

18. A method of servicing printheads of a plurality of inkjet print cartridges without removing the print cartridges from a printer carriage, including the steps of:

providing a printhead service module for separately servicing only a single corresponding printhead, the printhead service module having a wiper or a cap or a spittoon for maintenance and protection of the single corresponding printhead; and manually mounting the printhead service module on a support member of a printer for periodic servicing of the single corresponding printhead during periods of non-printing.

19. The method of claim 18, wherein the printhead service module further provides a primer connection.

20. The method of claim 18, further including the step of replacing the printhead service module with another service module when a print cartridge having a printhead corresponding to the service module is replaced with another print cartridge having a printhead corresponding to the other service module.

21. An inkjet printing system for applying different color inks to media from a plurality of printheads, comprising:

a printer having a scanning carriage which moves between a print zone and a servicing zone;

a plurality of printheads mounted on said scanning carriage;

a service carriage on said printer located in said print zone;

a plurality of printhead service modules mounted on said service carriage, each servicing module being separately removable and replaceable without interference with another servicing module, and each servicing module respectively dedicated for servicing only one of said printheads, and each servicing module including at least one maintenance component selected from the following group: wiper, capper, primer and spittoon.

22. The printing system of claim 21 which further includes printheads having separate types of ink respectively selected from the following group: black, cyan, magenta and yellow.

23. The printing system of claim 21 which includes a wiper.

24. The printing system of claim 23 which includes a capper.

25. The printing system of claim 24 which includes a primer.

26. The printing system of claim 25 which includes a spittoon.

27. The printing system of claim 21 which includes a capper.

28. The printing system of claim 21 which includes a primer.

29. The printing system of claim 21 which includes a spittoon.

30. The printing system of claim 21 which further includes motor means for providing relative movement between said printhead service modules and said printheads when said printer carriage is positioned in said servicing zone.

31. The printing system of claim 30 wherein said motor means includes a motor for moving the service carriage when said printer carriage is positioned in said servicing zone.

32. The method of claim 18 wherein said printhead service module has a wiper and a cap and a spittoon for maintenance and protection of the single corresponding printhead.

* * * * *